US007964095B1

(12) United States Patent
Graybeal

(10) Patent No.: US 7,964,095 B1
(45) Date of Patent: Jun. 21, 2011

(54) FLOOR DRAIN

(76) Inventor: K. Michael Graybeal, Bloomington, IL (US)

( * ) Notice: Subject to any disclaimer, the term of this patent is extended or adjusted under 35 U.S.C. 154(b) by 0 days.

(21) Appl. No.: 12/661,094

(22) Filed: Mar. 10, 2010

Related U.S. Application Data

(60) Provisional application No. 61/209,874, filed on Mar. 11, 2009.

(51) Int. Cl.
*E03F 5/04* (2006.01)

(52) U.S. Cl. ..... 210/164; 210/232; 210/474; 4/288; 4/292; 52/302.1

(58) Field of Classification Search ..... 210/163, 210/164, 232, 460, 474; 4/288, 292, 679; 52/302.1
See application file for complete search history.

(56) References Cited

U.S. PATENT DOCUMENTS

| | | | | | |
|---|---|---|---|---|---|
| 1,792,345 | A * | 2/1931 | Williams | 210/164 |
| 2,190,532 | A * | 2/1940 | Lukomski | 210/164 |
| 2,749,999 | A * | 6/1956 | Schmid | 4/288 |
| 4,505,814 | A * | 3/1985 | Marshall | 4/288 |
| 4,614,065 | A * | 9/1986 | Papp | 52/20 |
| 4,883,590 | A * | 11/1989 | Papp | 210/164 |
| 4,910,811 | A * | 3/1990 | Izzi, Sr. | 4/292 |
| 4,984,309 | A * | 1/1991 | Lowry | 4/288 |
| 5,618,416 | A * | 4/1997 | Haefner | 210/163 |
| 6,687,925 | B2 * | 2/2004 | Minnick | 4/292 |
| 6,766,545 | B2 * | 7/2004 | Hodges | 210/164 |
| 2008/0017562 | A1 * | 1/2008 | Tripodi et al. | 210/163 |
| 2009/0223884 | A1 * | 9/2009 | Wroblewski et al. | 210/163 |

* cited by examiner

*Primary Examiner* — Christopher Upton
(74) *Attorney, Agent, or Firm* — Philip L. Bateman

(57) ABSTRACT

A floor drain communicates with a vertical floor drain pipe. The floor drain has a flanged cylindrical body that fits within the vertical pipe or fitting, a ring that overlaps and is spaced above the flange, and a grate or cover that fits upon the upper surface of the ring. The ring is supported by elevating screws that pass through the flange of the body. Adjustment of the elevating screws enable the height and pitch of the ring and grate or cover to be quickly and easily adjusted.

7 Claims, 1 Drawing Sheet

FLOOR DRAIN

CROSS-REFERENCE TO RELATED APPLICATION

This application claims the benefit of U.S. Provisional Application Ser. No. 61/209,874, Mar. 11, 2009.

FIELD OF THE INVENTION

This invention relates to plumbing. More particularly, this invention relates to floor drains and cleanouts.

BACKGROUND OF THE INVENTION

Buildings are commonly constructed with concrete floors having openings that communicate with a sewer system. A floor opening is commonly referred to as a floor drain when a grate (also known as a strainer) is placed over the opening and is commonly referred to as a cleanout when a solid cover (also known as a plug) is placed over the opening. The primary purpose of a floor drain is to allow water on the floor to escape and the primary purpose of a cleanout is to provide access to the sewer system for cleaning. The term "floor drain" is used herein to refer to both types of floor openings. The parts that typically make up a floor drain consist of a grate (or cover) and a cylindrical body. The cylindrical body fits either directly into a vertical pipe or into a mating, outer cylindrical fitting that is, in turn, attached to a vertical pipe. Floor drains of many different designs and materials are used commercially.

Concrete floors are typically constructed with a slight pitch (or slope) so that water will run to the floor drain. The grate or cover of the floor drain is preferably flush with the finish surface of the floor. During building construction, the vertical pipe and outer cylindrical body that will form parts of the floor opening are typically set in place before the concrete is poured. If the vertical pipe is not set exactly perpendicular to the finished surface of the floor and at exactly the right height, the grate or cover of the floor drain will not be flush. Accordingly, a variety of floor drains have been disclosed that enable the height and pitch of the grate or cover to be adjusted after the floor has been poured.

As one example, Papp, U.S. Pat. No. 4,614,065, Sep. 30, 1986, discloses a cleanout having an outer cylindrical body that threads down upon an inner cylindrical body to adjust the height. A cap rests upon the outer body. The inner surface of the outer body and the lower surface of the cap contain complementary spherical surfaces that enable the pitch of the cap to be varied. Once the desired pitch is obtained, a bolt is tightened to fix the cap and a cover plate in the desired position.

As a second example, Papp, U.S. Pat. No. 4,883,590, Nov. 28, 1989, discloses a floor drain with an inner cylindrical body that threads down upon an outer cylindrical body to adjust the height. A ring rests upon the inner body. The inner surface of the inner body and the lower surface of the ring contain complementary spherical surfaces that enable the pitch of the ring to be varied. Once the desired pitch is obtained, three screws are tightened to fix the ring in the desired position. The grate is then attached.

Both the Papp cleanout and the Papp floor drain suffer from the same disadvantages. First, they both contain numerous parts. Second, they both require the grate or cover to be removed for adjustment of height and pitch. Third, they both require a multiple-step adjustment process. One body must first be threaded onto a second body to obtain approximately the desired height. The cap (for the cleanout) or the ring (for the drain) must then be moved to a position that is flush with the floor. A readjustment of height is often necessary before the flush position can be attained. The cap or ring must then be secured in position by tightening a bolt or three screws.

Accordingly, there is a demand for an improved floor drain having minimal parts. There is also a demand for a floor drain that enables the height and pitch of the grate or cover to be adjusted while they are in place. There is further a demand for a floor drain that enables the height and pitch of the grate or cover to be adjusted quickly and easily in one step.

SUMMARY OF THE INVENTION

The general object of this invention is to provide an improved floor drain. A more particular object is to provide a floor drain with minimal parts that enables the height and pitch of the grate or cover to be adjusted quickly and easily with the grate or cover in place.

I have invented an improved floor drain for communicating with a vertical floor pipe and/or fitting. The floor drain comprises: (a) a flanged cylindrical body comprising: (i) a cylinder having a vertical axis, a top, a bottom, and an outer surface, the bottom of the cylinder adapted to fit within a vertical floor drain pipe; (ii) a horizontal flange extending outwardly from the top of the cylinder, the flange having at least three radially spaced apart threaded openings; and (iii) at least three elevating screws engaging the threaded openings in the flange, each elevating screw extending above the flange and having a head with a diameter and with a recess for engagement by a rotating tool; (b) a ring that fits over the flange in an overlapping relationship, the ring having an upper surface and openings that overlap the elevating screws of the flange, the openings having a diameter less than the diameter of the heads of the elevating screws so that the ring is supported by the screws and is elevated above the flange and so that a plane defined by the ring is adjusted relative to a plane defined by the flange by screwing or unscrewing the elevating screws; and (c) a grate or cover that fits onto the upper surface of the ring.

The floor drain of this invention has only three major parts. It enables the height and pitch of the grate or cover to be adjusted quickly and easily in one step with the grate or cover in place.

DETAILED DESCRIPTION OF THE INVENTION

Figure 1:
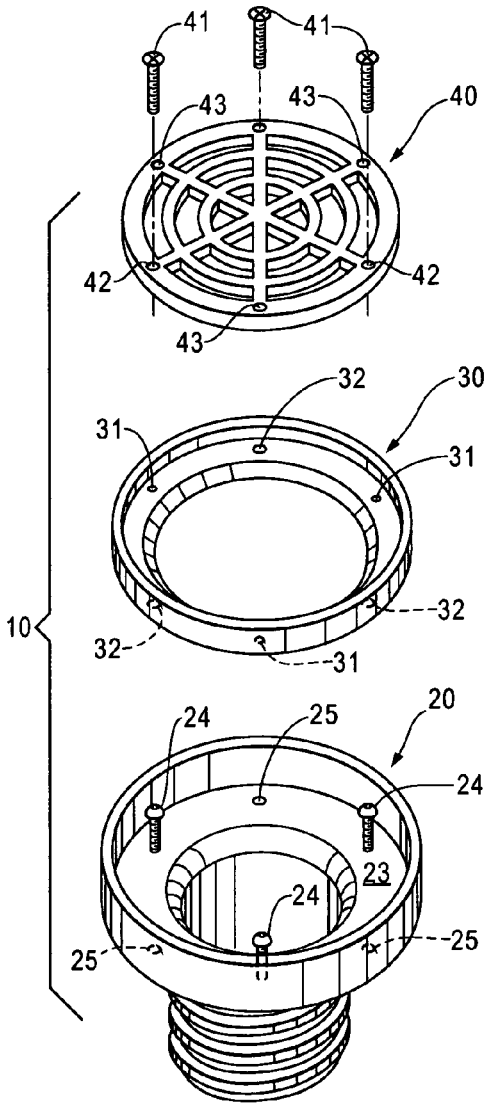
FIG. 1 is an exploded perspective view of a preferred embodiment of the floor drain of this invention.
Figure 2:
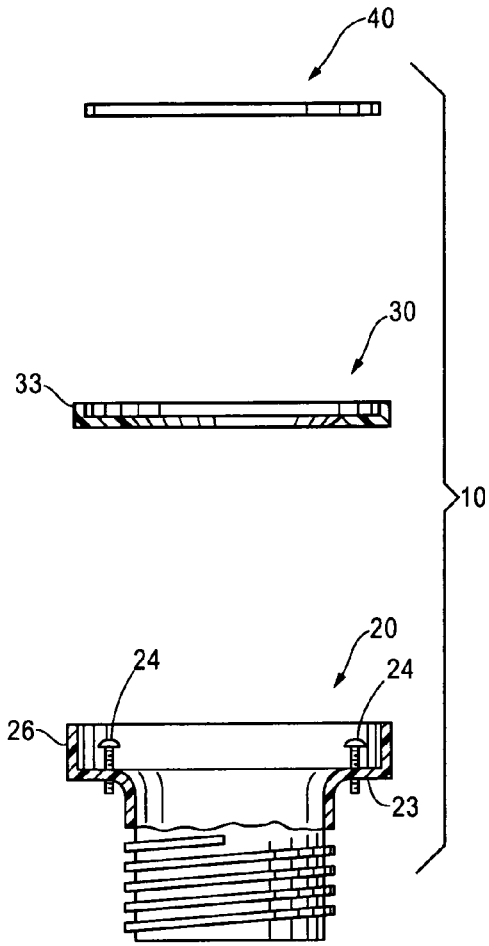
FIG. 2 is an exploded front elevation view thereof, partially in section.

This invention is best understood by reference to the drawings. Referring to FIGS. 1 and 2, the preferred embodiment of the floor drain 10 of this invention comprises a flanged cylindrical body 20, a ring 30, and a grate or cover 40. Grates and covers are similar in construction with the obvious difference that a grate contains multiple openings for the passage of water. For simplicity, only a grate is discussed below. However, it is understood that covers are included. The floor drain fits into a vertical pipe that may or may not include a fitting (not shown) that is below floor level. Each of the components of the floor drain is discussed in detail below.

The flanged cylindrical body 20 is the component of the floor drain that directly communicates with the vertical pipe or fitting. The cylinder (cylindrical portion) 21 of the body has a vertical axis and fits within the vertical pipe or fitting. A watertight seal is formed between the outer surface of the body and the inner surface of the vertical pipe or fitting. The preferred embodiment of the body contains threads 22 on the outer surface of the cylinder and is suitable for use with a fitting that contains mating threads on its inner surface. The structure, size, and shape of the cylinder are chosen to mate with the vertical pipe or fitting.

A horizontal flange 23 extends outwardly from, and perpendicularly to, the top of the cylinder. The flange contains at least three elevating screws 24 that extend upwardly from the flange and pass through threaded openings in the flange. As explained below, the elevating screws support, and determine the pitch of, the ring and grate. Each elevating screw contains an enlarged head with a recess (e.g., a slot recess, a Phillips recess, a TORX recess, etc.) for engagement by a rotating tool (e.g., a screwdriver, hex wrench or hex key, etc.). A minimum of three elevating screws is necessary to set the pitch (because a minimum of three points are required to define a plane), but more are used if desired. The elevating screws are spaced apart radially (i.e., they are distributed around the flange). The elevating screws are preferably spaced equally apart. To illustrate, if the flange contains three elevating screws, they are preferably spaced apart by 120 degrees, if the flange contains four elevating screws, they are preferably spaced apart by 90 degrees, etc. In the preferred embodiment, the flange also contains three additional threaded openings 25 that receive the grate attachment screws.

The preferred embodiment of the flanged cylindrical body contains a vertical wall 26 that extends upwardly from the outer perimeter of the flange. As explained below, the wall prevents wet concrete from covering the flange during the pouring of the floor. If the wall is omitted, a disposable cylindrical cover or the like must be placed over the flanged cylindrical body during the pour.

The preferred embodiment of the flanged cylindrical body is integral (i.e., the cylinder and flange are made of a single piece). If desired, the body is formed of two or more parts. For example, an alternate embodiment of the flanged cylindrical body contains a separate disc that fits over the flange and within the vertical wall to provide additional height adjustability. The disc contains outer threads that mate with inner threads on the vertical wall. The elevating screws pass through both the disc and the flange.

The ring 30 overlaps the flange of the flanged cylindrical body. More particularly, it fits within the wall and rests upon the heads of the elevating screws. The ring is thus elevated above the flange and its pitch is determined by the adjustable heights of the elevating screws. The ring contains three openings 31 that overlap the elevating screws and are large enough to enable the appropriate rotating tool to pass through the flange to engage the elevating screws. The diameter of the openings is less than the diameter of the heads of the elevating screws so that the ring is supported on the heads.

Figure 2A:
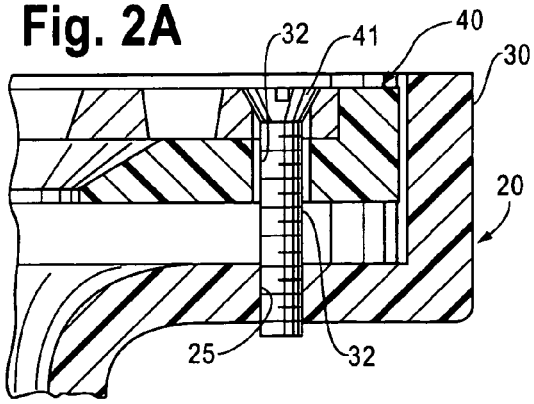
FIGS. 2A and 2B are details thereof.
Figure 2B:
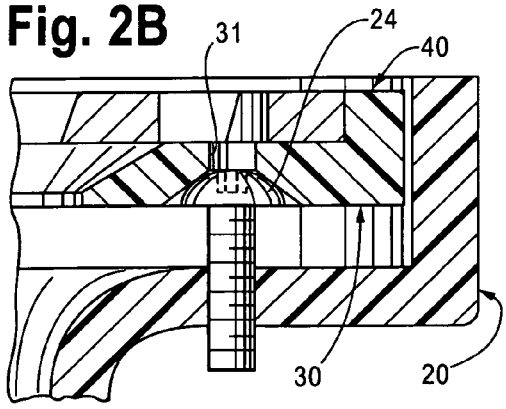

As seen in FIG. 2B, the lower (underside) surface of the ring preferably contains indentations around the openings that conform to the shape of the heads of the elevating screws. The indentations serve two purposes. First, they allow the ring to lower to the surface of the flange, which in turn provides slightly more range in the height adjustability. Second, they help to seat the ring in the desired position with the openings directly over the elevating screws. In the preferred embodiment, the ring contains three additional openings 32 for passage of the grate attachment screws. The ring preferably contains a shoulder 33 that forms a recess into which the grate fits.

As seen in FIGS. 2 and 2A, the grate 40 fits onto the upper (topside) surface of the ring and is secured in place with attachment screws 41 that pass through openings 32 in the ring and engage threaded openings in the flange. The grate preferably contains openings 43 that enable the elevating screws to be adjusted with the grate in place.

The materials with which the flanged cylindrical body and ring are made are matters of choice and are commonly chosen to mate with the materials of the vertical pipe and/or fitting. Suitable materials include non-corrosive metals such as coated cast iron, stainless steel, and bronze, and molded plastics such as polyvinyl chloride (PVC), acrylonitrile butadiene styrene (ABS), and high density polyethylene (HDPE). Even if the body and ring are made of molded plastic, the grate is preferably made of a non-corrosive metal for additional strength and durability.

The installation and use of the floor drain can now be considered. After the vertical pipe (with or without a separate fitting) are set in place, and before the concrete floor is poured, the flanged cylindrical body (with or without the ring and grate in place) is connected to the pipe or fitting. The elevating screws of the body are preferably screwed in (lowered) as far as possible initially. A disposable cover is put into place to prevent concrete from entering the interior of the floor drain. The concrete floor is then poured and finished.

After the concrete floor has hardened, the disposable cover is removed. If not already in place, the ring is then set in place on the flange and the elevating screws are adjusted by unscrewing (raising) them to make the top of the ring perfectly flush with the surrounding floor. It can be appreciated that the adjustability range is increased as the length of the elevating screws increases. If not already in place, the grate (or cover) is then set in place on the ring and secured using the attachment screws. The adjustment process is thus performed quickly and easily in one step.

I claim:

1. A floor drain for communicating with a vertical floor drain pipe, the floor drain comprising:

(a) a flanged cylindrical body comprising: (i) a cylinder having a vertical axis, a top, a bottom, and an outer surface, the bottom of the cylinder adapted to fit within a vertical floor drain pipe; (ii) a horizontal flange extending outwardly from the top of the cylinder, the flange having at least three radially spaced apart threaded openings; and (iii) at least three elevating screws engaging the threaded openings in the flange, each elevating screw extending above the flange and having a head with a diameter and with a recess for engagement by a rotating tool;

(b) a ring that fits over the flange in an overlapping relationship, the ring having an upper surface and openings that overlap the elevating screws of the flange, the openings having a diameter less than the diameter of the heads of the elevating screws so that the ring is supported by the screws and is elevated above the flange and so that a plane defined by the ring is adjusted relative to a plane defined by the flange by screwing or unscrewing the elevating screws; and (c) a grate or cover that fits onto the upper surface of the ring.

2. The floor drain of claim 1 wherein the flange contains an upwardly projecting wall around its perimeter.

3. The floor drain of claim 2 wherein the outer surface of the cylinder contains threads.

4. The floor drain of claim 3 wherein the ring contains a recess in its upper surface and wherein the grate or cover fits within the recess.

5. The floor drain of claim 4 wherein the flanged cylindrical body contains three elevating screws that are spaced apart by about 120 degrees.

6. The floor drain of claim 5 wherein the ring has a lower surface with indentations around the openings.

7. A floor drain for communicating with a vertical floor drain pipe, the floor drain comprising:

(a) a flanged cylindrical body comprising: (i) a cylinder having a vertical axis, a top, a bottom, and an outer surface, the bottom of the cylinder adapted to fit within a vertical floor drain pipe; (ii) a horizontal flange extending outwardly around the top of the cylinder, the flange having at least three radially spaced apart openings; and (iii) at least three height-adjustable elevating supports engaging the openings in the flange, each elevating support extending above the flange and having a head with a diameter;

(b) a ring that fits over the flange in an overlapping relationship, the ring having an upper surface and openings that overlap the elevating supports of the flange, the openings having a diameter less than the diameter of the heads of the elevating supports so that the ring is retained by the supports and is elevated above the flange and so that a plane defined by the ring is adjusted relative to a plane defined by the flange by adjusting the height of the elevating supports; and (c) a grate or cover that fits onto the upper surface of the ring.

* * * * *